US006494993B1

(12) United States Patent
Suonperä

(10) Patent No.: US 6,494,993 B1
(45) Date of Patent: Dec. 17, 2002

(54) MULTI-LAYER WEB FORMATION BY MEANS OF A SIMPLE BASIC-STOCK SYSTEM

(75) Inventor: Antti Suonperä , Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/830,817

(22) PCT Filed: Oct. 26, 1999

(86) PCT No.: PCT/FI99/00890

§ 371 (c)(1),
(2), (4) Date: Apr. 27, 2001

(87) PCT Pub. No.: WO00/26467

PCT Pub. Date: May 11, 2000

(30) Foreign Application Priority Data

Oct. 29, 1998 (FI) ..... 982351

(51) Int. Cl.[7] ..... D21F 11/04

(52) U.S. Cl. ..... 162/216; 162/123; 162/125; 162/129

(58) Field of Search ..... 162/336, 339, 162/343–347, 216, 212, 123, 125, 129

(56) References Cited

U.S. PATENT DOCUMENTS

| | | | | | |
|---|---|---|---|---|---|
| 3,640,843 | A | * | 2/1972 | Means | 162/343 |
| 4,021,295 | A | * | 5/1977 | Schmaeng | 162/125 |
| 4,384,922 | A | * | 5/1983 | Stotz | 162/259 |
| 4,961,824 | A | | 10/1990 | Laitinen et al. | 162/123 |
| 5,607,555 | A | | 3/1997 | Grossmann et al. | 162/304 |
| 5,626,722 | A | * | 5/1997 | Huovila | 162/343 |
| 5,746,889 | A | * | 5/1998 | Huovila et al. | 162/216 |
| 6,210,535 | B1 | * | 4/2001 | Huovila et al. | 162/322 |
| 6,270,624 | B1 | * | 8/2001 | Houvila et al. | 162/127 |

FOREIGN PATENT DOCUMENTS

| | | |
|---|---|---|
| DE | 19624127 | 12/1997 |
| EP | 0745721 | 12/1996 |
| FI | 71377 | 9/1986 |
| FI | 92729 | 12/1994 |
| WO | 9817860 | 4/1998 |

* cited by examiner

*Primary Examiner*—Jose A. Fortuna
(74) *Attorney, Agent, or Firm*—Steinberg & Raskin, P.C.

(57) ABSTRACT

The invention concerns multi-layer web formation by means of a simple basic-stock system and in particular a method for regulation of the properties of the different layers in a stock system that comprises several layers by means of additional stocks. The source (M) of basic stock is divided into 2 . . . n separate component flows ($M_1$ . . . $M_n$), with which additional stocks ($B_1$ . . . $B_n$) are mixed so as to form homogeneous mixtures with the basic stock, and the homogeneous stock flows are passed further by means of pumps ($A_1$ . . . $A_n$) through machine screens ($s_1$ . . . $S_n$) into the inlet header of a multi-layer headbox (P).

16 Claims, 1 Drawing Sheet

MULTI-LAYER WEB FORMATION BY MEANS OF A SIMPLE BASIC-STOCK SYSTEM

FIELD OF THE INVENTION

The invention relates to the formation of a multi-layer web by means of a simple basic-stock system and in particular to a method for the regulation of the properties of the different layers in a system comprising a number of layers formed by means of additional stocks.

BACKGROUND OF THE INVENTION

As is well known, paper or board is formed out of one or several layers. The stock is prepared from either one or several fresh stocks and passed to the paper or board machine into each inlet header along one or several fresh-stock lines out of the same fresh stock or separate fresh stocks. To the fresh stocks, as a rule, the necessary chemicals and fillers are added in order to regulate the properties of the layers, such as flocculation and formation. Different stocks and stock lines can be passed into the different layers in multi-layer web formation, and the properties of the stocks in a simple stock system can be varied by means of additives and chemicals by feeding said agents into the different layers as appropriate quantities.

In the FI Patent 71, 377, a method for manufacture of multi-layer board is described, in which the stock suspension that forms one of the surface layers is fed onto the horizontal portion of a first wire. Between the layers, a third stock suspension is fed, which forms an intermediate la er, ahead of a wedge-shaped gap formed by a second wire onto the web layer already formed. After this the first wire and the two web layers are passed into contact with a third wire, onto whose horizontal portion the stock suspension is fed that forms the other surface layer. The consistency of the stock suspension that forms the intermediate layer is considerably higher than the consistencies of the stock suspensions that form the surface layers.

In the U.S. Pat. No. 5,607,555, a paper machine for manufacture of multi-layer paper is described. In this machine, there are at least two twin-web formers, which produce a multi-layer paper web, in which connection a paper is obtained whose properties at both faces are equal.

In the FI Patent 92,729, a stock feed system for a multi-layer headbox and a method in the operation of a multi-layer headbox are described. In this system, a stock produced out of the same fresh stock is passed into each inlet header of the multi-layer headbox, to which stock the necessary chemicals and fillers have been added.

In the published patent application DE 196 24 127, a method of multi-layer web formation is described, which comprises several, at least three, stock layers, of which the compositions of the outermost stock layers have been chosen so that draining of water out of them takes place more readily than out of the stock layer in the middle. The outer layers comprise long fibres, in which case the layers are more porous. This promotes the draining of water and the drying of the paper web.

The prior-art solutions involve a number of significant drawbacks. A separate headbox that sprays starch or fibre suspension is an expensive solution, and its use is restricted mainly to board machines and to low speeds below 1000 meters per minute. In solutions in which one or several stock layers are ground, the draining of water is clearly reduced, and thereby the runnability and the efficiency of production become lower, and the costs become higher. When the running speeds of paper and board machines rise to a level clearly higher than 1000 meters per minute, the requirements imposed on the compositions of the stock layers change decisively, and problems start occurring both in the process and in the quality of the product with the prior-art solutions. The so-called basic stock currently used does not meet the ever increasing requirements concerning the profiles of paper grades in the direction of thickness, of which requirements, as an example should be mentioned bonding strength and smoothness of the paper, and this problem cannot be solved by means of addition of admixtures to the layers. Further, in the prior-art methods, the different stocks are introduced onto the web separately as layers of their own.

OBJECTS AND SUMMARY OF THE INVENTION

The object of the present invention is a method for the formation of a multi-layer web by means of a simple basic-stock system, in which additional stocks are fed to among the basic stock or stocks in order to regulate the web formation consistencies and the strengths of the layers and the printing properties of the product.

It is a further object of the present invention to solve the problems that have been encountered in the prior-art solutions.

It has been noticed that the objectives of the present invention can be achieved by using a method of multi-layer web formation.

BRIEF DESCRIPTION OF THE DRAWINGS

The invention will be described in the following in more detail with reference to a preferred embodiment of the invention illustrated in the figure in the accompanying drawing, the invention being, however, not supposed to be confined to said embodiment alone.

DETAILED DESCRIPTION OF THE INVENTION

Figure 1:
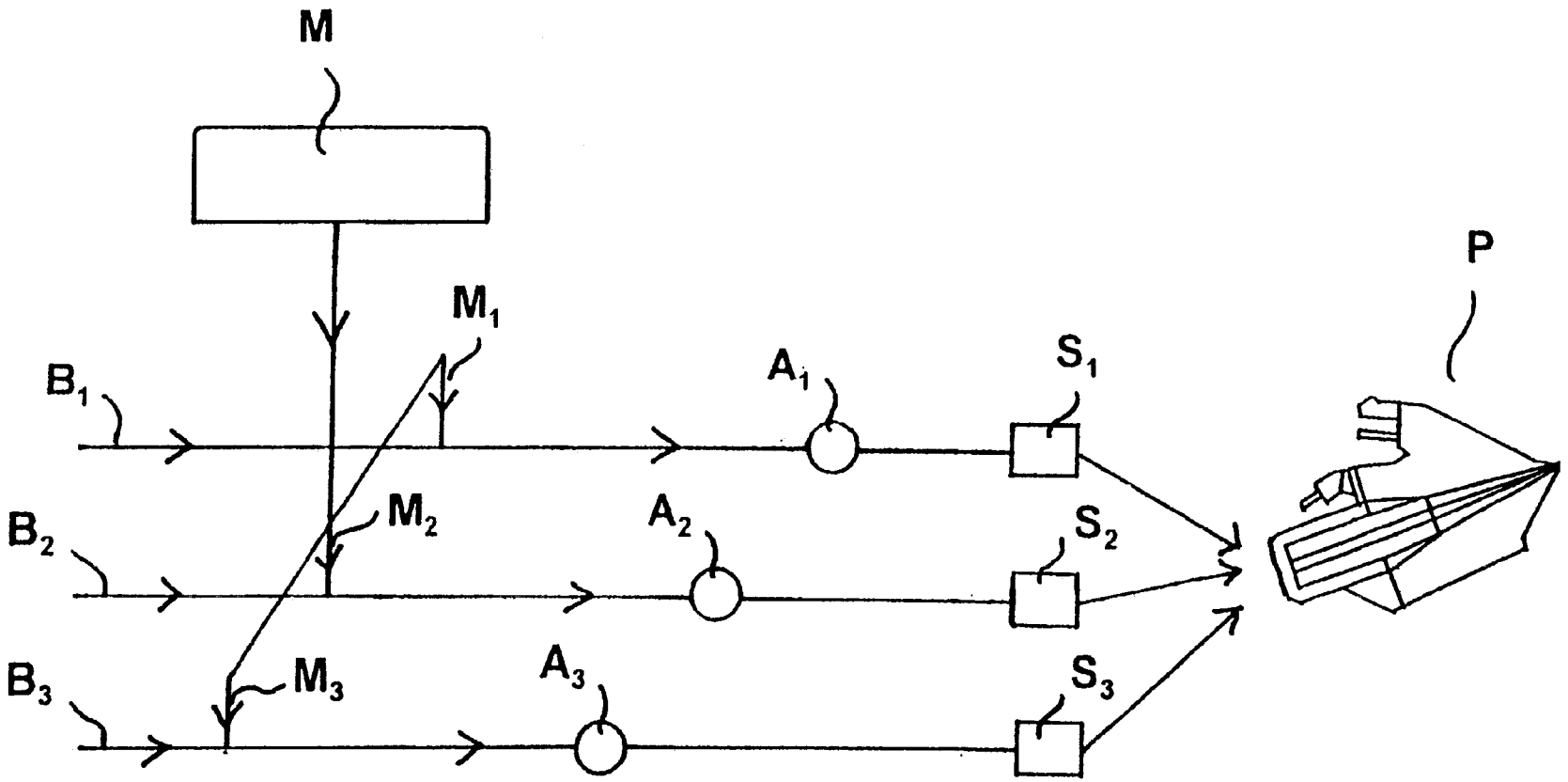
FIG. 1 is a schematic representation of the system according to the present invention in which the stock is divided into three component flows, which flows are passed further into the different inlet headers in the multi-layer head box.

FIG. 1 illustrates a preferred embodiment of the invention in particular suited for manufacture of paper, in which embodiment a stock flow M produced out of the same source of basic stock is divided into three separate component stock flows $M_1$, $M_2$ and $M_3$, with which additional stocks $B_1$, $B_2$ and $B_3$ are mixed, which are mixed as homogeneous mixtures with the basic stock at a mixing point, at which it is favourably possible to employ differences in speed or a particular mixing device in order to achieve mixing. The additional stocks $B_1$, $B_2$ and $B_3$ can be of the same stock, of different stocks, and/or mixtures of each other, so that the additional stocks can be: $B_1=B_2=B_3$ or $B_1\neq B_2$ or $B_1=B_3$ or $B_1\neq B_2\neq B_3$ or $B_1\neq B_3$. The homogeneous stock flows are passed further by means of the pumps $A_1$, $A_2$ and $A_3$ forwards through the machine screens $S_1$, $S_2$ and $S_3$ into the inlet header of the multi-layer headbox P. The source of basic stock M can comprise at least one stock source, which can be, for example, one short circulation or, in it, the pipe system of a stock coming from deaeration; the source B of additional stock can comprise at least one stock source, and it may also comprise mixtures of different stocks. The flow of basic stock M is divided into 2 . . . n stock flows, preferably 2 . . . 3 stock flows. The machine screens S can be of equal magnitude or of different magnitudes. Into the stock flows, it is also possible to introduce additives known in the art at suitable points along the stock lines as required.

In the solution in accordance with the present invention, a simple system of basic stock is used, in which the source of basic stock can be any pulp whatsoever, such as recycled pulp, mechanical pulp, or stock based on chemical pulp. In such a case, to one or several basic stocks, a different stock or the same stock is added. To a low-cost basic stock, such as recycled pulp, it is possible to add a stock based on chemical pulp or an additional stock of a different degree of grinding to increase the strength, or mechanical pulp, and it is possible to add additional stocks which have different consistencies. To a low-cost basic stock, it is necessary to add just the required amount of more expensive additional stock in consideration of the desired final result, whereby clear economies are obtained in the costs. On the other hand, if a more expensive basic stock or source of basic stock is used, such as stock based on chemical pulp, it is possible to retain the good properties of the basic stock, which properties can be modified further in compliance with a desired possible particular application by, if necessary, adding, a second stock. In some cases it is enough that additional stock is added to certain layers only, appropriately, for example, to the middle layer only or to the surface layers only. In such a case, it is possible to carry out fine adjustment of the properties of the final product and also, for example, to amend deficiencies of poorly operating equipment, such as to compensate for drawbacks of a former that operates unequalsidedly. In this way, considerable economies are obtained, as compared with a conventional method of application of fibres as layers, in which, for example, a number of short circulations are needed, which require a higher number of equipment, more space, and involve higher costs and maintenance expenses. Particularly great advantages are obtained with heavier paper grades, such as fine papers whose basis weight is ≧80 grams per square meter, in which the source of additional stock for the middle layer consists of recycled fibres (DIP) or CTMP. whose cost is clearly lower than the cost of chemical pulp. In such a case, CTMP improves the bulk and the bonding strength of the paper in the case of coated paper.

Further, in the solution in accordance with the present invention, it is possible to use a stock based on chemical pulp as the basic stock and, for example, groundwood pulp as the stock for the middle layer. The amount of additional stock that is used is favourably 5 . . . 50% of the total quantity of stock. The number of the layers can be 2 . . . n, preferably 2 . . . 3 layers, which are passed into the multi-layer headbox, and it is the object that the stocks should not be mixed with each other before the wire part. Further, it is required that all the stock components are homogeneous mixtures. Suitable additional stocks are, for example, in the surface layers of fine paper, acacia or eucalyptus, with which bulk, stiffness and formation potential are obtained for the product. Advantageously, in the case of LWC, it is possible to add an appropriately ground reinforcement stock into the middle layer, in which case fine material based on chemical pulp and having a good bonding capacity and, thus, good bonding strength are obtained. By means of the method in accordance with the invention, it is possible to manufacture paper and/or board of very high quality and to fine-adjust the quality of the product while at the same time optimizing the costs.

What is claimed is:

1. A method of multi-layer web formation for a paper or board machine, comprising the the steps of:

dividing a source (M) of basic stock into two or more separate component flows ($M_1$ . . . $M_n$);

mixing said divided basic stock with additional stocks ($B_1$ . . . $B_n$) so as to form homogeneous stock flow mixtures with the basic stock wherein differences in speed or a mixing device are used to achieve mixing; and passing the homogeneous stock flow mixtures further by means of pumps ($A_1$ . . . $A_n$) through machine screens ($S_1$ . . . $S_n$) into an inlet header of a multi-layer headbox (P).

2. A method as claimed in claim 1, wherein the source (M) of basic stock comprises:

one stock or mixtures of several stocks.

3. A method as claimed in claim 1, wherein the sources of additional stocks ($B_1$ . . . $B_n$) comprise:

at least one of the same stocks, different stocks and mixtures of stocks.

4. A method as claimed in claim 1, wherein the basic stock comprises:

one of recycled pulp, mechanical pulp and stock based on chemical pulp.

5. A method as claimed in claim 1, wherein the additional stocks comprise:

at least one of a stock based on chemical pulp, a mechanical pulp, a chemical based pulp of different grinding degrees, recycled fibres (DIP), CTMP, acacia, eucalyptus, and mixtures of same.

6. A method as claimed in claim 1, wherein the amount of additional stock that is used is from 5 to 50% of the whole quantity of stock.

7. A method as claimed in claim 1, wherein said additional stock is added to a middle layer of said multi-layer web only.

8. A method as claimed in claim 1, wherein said additional stock is added to surface layers of said multi-layer web only.

9. A method for the formation of a multi-layer web in a paper or board machine, comprising the steps of:

dividing a source (M) of basic stock into at least two separate component stock flows ($M_1$ . . . $M_n$);

mixing said at least two separate component stock flows with at least one additional stock ($B_1$ . . . $B_n$) to form a plurality of homogeneous stock flow mixtures wherein one of differences in speed or a mixing device are used to achieve mixing; and passing each of said plurality of homogeneous stock flow mixtures, by means of a plurality of pumps ($A_1$ . . . $A_n$), through a plurality of respective machine screens ($S_1$ . . . $S_n$) into an inlet header of a multi-layer headbox (P).

10. The method according to claim 9, wherein said source (M) of basic stock comprises:

one of a single stock and a mixture of several stocks.

11. The method according to claim 9, wherein the sources of additional stocks ($B_1$ . . . $B_n$) comprise:

at least one of the same stocks as said source of basic stock, different stocks than said source of basic stock and mixtures of said same stocks as said basic stock source and different stocks than said basic stock source.

12. The method according to claim 9, wherein the basic stock comprises:

one of recycled pulp, mechanical pulp and stock based on a chemical pulp.

13. The method according to claim 9, wherein the additional stocks comprise:

at least one of a stock based on a chemical pulp, a mechanical pulp, a chemical based pulp of different grinding degrees, recycled fibers (DIP), CTMP, acacia and eucalyptus.

14. The method according to claim 9, wherein the amount of additional stock that is used to form said plurality of homogeneous stock flow mixtures is from about 5 to 50% of the whole quantity of all of the stocks combined.

15. The method according to claim 9, wherein said additional stock is added to a middle layer of said multi-layer web only.

16. The method according to claim 9, wherein said additional stock is added to surface layers of said multi-layer web only.

* * * * *